US011585588B2

(12) United States Patent
Petrenko et al.

(10) Patent No.: US 11,585,588 B2
(45) **Date of Patent: *Feb. 21, 2023**

(54) SYSTEM AND METHOD FOR ENERGY-SAVING INDUCTIVE HEATING OF EVAPORATORS AND OTHER HEAT-EXCHANGERS

(71) Applicant: John S. Chen, Canaan, NH (US)

(72) Inventors: Victor F. Petrenko, Lebanon, NH (US); Cheng Chen, White River Junction, VT (US); Fedor V. Petrenko, Lebanon, NH (US)

(73) Assignee: John S. Chen, Canaan, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/595,142

(22) Filed: Jan. 12, 2015

(65) Prior Publication Data

US 2015/0121912 A1 May 7, 2015

Related U.S. Application Data

(63) Continuation of application No. 12/953,271, filed on Nov. 23, 2010, now Pat. No. 8,931,296.
(Continued)

(51) Int. Cl.
*F25D 21/00* (2006.01)
*F25D 21/08* (2006.01)
(Continued)

(52) U.S. Cl.
CPC ..... *F25D 21/08* (2013.01); *F24D 19/0095* (2013.01); *F24H 1/105* (2013.01);
(Continued)

(58) Field of Classification Search
CPC ..... F25D 21/006; F25D 21/002; F25D 21/08; F25D 2400/04; F24D 19/0095;
(Continued)

(56) References Cited

U.S. PATENT DOCUMENTS 1,157,344 A 10/1915 Thomas
1,656,329 A 1/1928 Sievert et al.
(Continued)

FOREIGN PATENT DOCUMENTS

BE 410547 7/1935
BE 528926 6/1954
(Continued)

OTHER PUBLICATIONS

International Search Report and Written Opinion received for PCT Patent Application No. PCT/US2009/063407 dated May 14, 2010, 12 pages.
(Continued)

*Primary Examiner* — Harry E Arant
(74) *Attorney, Agent, or Firm* — Morrison & Foerster LLP

(57) ABSTRACT

A novel method of deicing utilizing a fins-on-tubes type evaporator/heat exchanger system that is optimized for energy-saving inductive heating thereof, by configuring it to increase its resistance to a value at which the system's reactance at its working frequency is comparable to its electrical resistance. The system includes a set of tubes configured for flow of cooling material therethrough, and also includes a set of fins positioned and disposed perpendicular to, and along, the tubes, in such a way that at least a portion of the fins comprises longitudinal excisions therein.

12 Claims, 12 Drawing Sheets

(Exemplary Embodiment)

Related U.S. Application Data

(60) Provisional application No. 61/263,550, filed on Nov. 23, 2009.

(51) Int. Cl.

| | |
|---|---|
| ***F24D 19/00*** | (2006.01) |
| ***F24H 1/10*** | (2022.01) |
| ***F28F 1/32*** | (2006.01) |
| ***F28F 17/00*** | (2006.01) |
| ***H05B 3/42*** | (2006.01) |
| ***H05B 3/00*** | (2006.01) |
| ***F28D 1/047*** | (2006.01) |
| *F25B 39/02* | (2006.01) |
| *F28D 21/00* | (2006.01) |
| *F28G 13/00* | (2006.01) |

(52) U.S. Cl.
CPC ..... *F28D 1/0477* (2013.01); *F28F 1/32* (2013.01); *F28F 17/00* (2013.01); *H05B 3/0009* (2013.01); *H05B 3/42* (2013.01); *F25B 39/02* (2013.01); *F28D 2021/0071* (2013.01); *F28G 13/005* (2013.01)

(58) Field of Classification Search
CPC ..... F24H 1/105; F28D 1/0477; F28D 2021/0071; F28F 1/32; F28F 17/00; H05B 3/023; H05B 2/42; F25B 39/02; F28G 13/005
USPC ..... 62/80, 276, 315; 165/181
See application file for complete search history.

(56) References Cited

U.S. PATENT DOCUMENTS 1,998,575 A * 4/1935 Furnas ..... F25D 21/002 62/80
2,024,612 A 12/1935 Sulzberger
2,196,291 A * 4/1940 Clancy ..... F25D 21/008 62/155
2,205,543 A 6/1940 Rideau et al.
2,496,279 A 2/1950 Ely et al.
2,522,199 A * 9/1950 Shreve ..... F25D 21/08 62/234
2,819,373 A * 1/1958 Allman ..... B60H 1/00257 219/202
2,870,311 A 1/1959 Greenfield et al.
2,904,968 A * 9/1959 Spencer, Jr. ..... F25D 21/002 62/140
2,988,899 A 6/1961 Heron
2,994,207 A * 8/1961 Preotlejohn ..... F25D 17/062 62/155
3,204,084 A 8/1965 Spencer et al.
3,256,920 A 6/1966 Beyers
3,316,344 A 4/1967 Kidd et al.
3,316,345 A 4/1967 Toms et al.
3,380,261 A 4/1968 Hendrix et al.
3,487,654 A * 1/1970 Lorenz ..... F25D 21/025 62/140
3,544,762 A * 12/1970 Eisler ..... F24D 13/02 219/200
3,790,752 A 2/1974 Boaz et al.
3,809,341 A 5/1974 Levin et al.
3,825,371 A 7/1974 Roder et al.
3,835,269 A 9/1974 Skobelev et al.
3,915,883 A 10/1975 Van Meter et al.
3,964,183 A 6/1976 Mouat
3,971,056 A 7/1976 Jaskolski et al.
4,081,914 A 4/1978 Rautenbach et al.
4,082,962 A 4/1978 Burgsdorf et al.
4,085,338 A 4/1978 Genrikh et al.
4,119,866 A 10/1978 Genrikh et al.
4,135,221 A 1/1979 Genrikh et al.
4,137,447 A 1/1979 Boaz
RE29,966 E 4/1979 Nussbaum
4,190,137 A 2/1980 Shimada et al.
4,197,625 A 4/1980 Jahoda
4,278,875 A 7/1981 Bain
4,321,296 A 3/1982 Rougier
4,330,703 A 5/1982 Horsma et al.
4,369,350 A 1/1983 Kobayashi et al.
4,442,681 A 4/1984 Fischer
4,531,380 A 7/1985 Hagen
4,571,860 A 2/1986 Long
4,625,378 A 12/1986 Tanno et al.
4,638,960 A 1/1987 Straube et al.
4,690,353 A 9/1987 Haslim et al.
4,706,650 A 11/1987 Matzkanin
4,732,351 A 3/1988 Bird
4,737,618 A 4/1988 Barbier et al.
4,756,358 A 7/1988 O'Neal
4,760,978 A 8/1988 Schuyler et al.
4,764,193 A 8/1988 Clawson
4,773,976 A 9/1988 Vexler
4,798,058 A 1/1989 Gregory
4,814,546 A 3/1989 Whitney et al.
4,820,902 A 4/1989 Gillery
4,862,055 A 8/1989 Maruyama et al.
4,875,644 A 10/1989 Adams et al.
4,887,041 A 12/1989 Mashikian et al.
4,897,597 A 1/1990 Whitener
4,950,950 A 8/1990 Perry et al.
4,985,313 A 1/1991 Neck et al.
5,057,763 A 10/1991 Torii et al.
5,109,140 A 4/1992 Nguyen
5,112,449 A 5/1992 Jozefowicz et al.
5,143,325 A 9/1992 Zieve et al.
5,144,962 A 9/1992 Counts et al.
5,218,472 A 6/1993 Jozefowicz et al.
5,344,696 A 9/1994 Hastings et al.
5,398,547 A 3/1995 Gerardi et al.
5,408,844 A 4/1995 Stokes
5,411,121 A 5/1995 LaForte et al.
5,441,305 A 8/1995 Tabar
5,496,989 A 3/1996 Bradford et al.
5,523,959 A 6/1996 Seegmiller
5,551,288 A 9/1996 Geraldi et al.
5,582,754 A 12/1996 Smith et al.
5,605,418 A 2/1997 Watanabe et al.
5,744,704 A 4/1998 Hu et al.
5,861,855 A 1/1999 Arsenault et al.
5,873,254 A 2/1999 Arav
5,886,321 A 3/1999 Pinchok et al.
5,902,962 A 5/1999 Gazdzinski
5,934,617 A 8/1999 Rutherford
5,947,418 A 9/1999 Bessiere et al.
6,018,152 A 1/2000 Allaire et al.
6,027,075 A 2/2000 Petrenko
6,029,465 A * 2/2000 Bascobert ..... B60H 1/321 62/151
6,031,214 A 2/2000 Bost et al.
6,129,314 A 10/2000 Giamati et al.
6,133,555 A 10/2000 Brenn
6,145,787 A 11/2000 Rolls
6,161,393 A * 12/2000 Bascobert ..... B60H 1/321 62/131
6,193,793 B1 2/2001 Long
6,194,685 B1 2/2001 Rutherford
6,227,492 B1 5/2001 Schellhase et al.
6,237,874 B1 5/2001 Rutherford et al.
6,239,601 B1 5/2001 Weinstein
6,246,831 B1 6/2001 Seitz et al.
6,266,969 B1 7/2001 Malnati et al.
6,270,118 B1 8/2001 Ichikawa
6,279,856 B1 8/2001 Rutherford et al.
6,294,765 B1 9/2001 Brenn
6,297,165 B1 10/2001 Okumura et al.
6,297,474 B1 10/2001 Kelly et al.
6,321,833 B1 11/2001 O'Leary et al.
6,330,986 B1 12/2001 Rutherford et al.
6,396,172 B1 5/2002 Couture
6,427,946 B1 8/2002 Petrenko

(56) References Cited

U.S. PATENT DOCUMENTS

| | | | | |
|---|---|---|---|---|
| 6,467,279 | B1 * | 10/2002 | Backman | F25B 5/00 62/113 |
| 6,492,629 | B1 | 12/2002 | Sopory | |
| 6,558,947 | B1 | 5/2003 | Lund et al. | |
| 6,653,598 | B2 | 11/2003 | Petrenko et al. | |
| 6,693,786 | B2 | 2/2004 | Petrenko | |
| 6,723,971 | B1 | 4/2004 | Petrenko et al. | |
| 6,825,444 | B1 | 11/2004 | Tuan et al. | |
| 6,870,139 | B2 | 3/2005 | Petrenko | |
| 7,034,257 | B2 | 4/2006 | Petrenko | |
| 7,638,735 | B2 | 12/2009 | Petrenko | |
| 8,424,324 | B2 | 4/2013 | Petrenko et al. | |
| 8,653,419 | B2 * | 2/2014 | Weiss | H05B 3/84 219/202 |
| 8,931,296 | B2 * | 1/2015 | Petrenko | F28F 1/32 62/276 |
| 2001/0052731 | A1 | 12/2001 | Petrenko | |
| 2002/0017466 | A1 | 2/2002 | Petrenko | |
| 2002/0023744 | A1 | 2/2002 | Kim et al. | |
| 2002/0092849 | A1 | 7/2002 | Petrenko | |
| 2002/0096515 | A1 | 7/2002 | Petrenko | |
| 2002/0118550 | A1 | 8/2002 | Petrenko et al. | |
| 2002/0170909 | A1 | 11/2002 | Petrenko | |
| 2002/0175152 | A1 | 11/2002 | Petrenko | |
| 2003/0019859 | A1 * | 1/2003 | Sol | H05B 3/84 219/203 |
| 2003/0024726 | A1 | 2/2003 | Petrenko | |
| 2003/0046942 | A1 | 3/2003 | Shedivy et al. | |
| 2003/0116551 | A1 * | 6/2003 | Sol | B32B 17/10192 219/203 |
| 2003/0155467 | A1 | 8/2003 | Petrenko | |
| 2003/0155740 | A1 | 8/2003 | Lammer | |
| 2004/0149734 | A1 | 8/2004 | Petrenko et al. | |
| 2005/0241812 | A1 | 11/2005 | Malone et al. | |
| 2006/0086715 | A1 | 4/2006 | Briggs | |
| 2006/0272340 | A1 * | 12/2006 | Petrenko | F25C 5/08 62/73 |
| 2007/0045282 | A1 | 3/2007 | Petrenko | |
| 2007/0101745 | A1 * | 5/2007 | Hsu | F24F 1/42 62/305 |
| 2007/0101753 | A1 | 5/2007 | Broadbent | |
| 2007/0246206 | A1 | 10/2007 | Gong et al. | |
| 2008/0028697 | A1 * | 2/2008 | Li | B32B 27/08 52/171.2 |
| 2008/0154159 | A1 * | 6/2008 | Kwong | G05D 23/08 601/20 |
| 2008/0196429 | A1 * | 8/2008 | Petrenko | F25C 1/12 62/207 |
| 2010/0107667 | A1 * | 5/2010 | Petrenko | F25D 21/08 62/151 |
| 2010/0206990 | A1 * | 8/2010 | Petrenko | B64D 15/163 244/134 D |
| 2011/0041537 | A1 * | 2/2011 | Pun | B01D 53/263 62/271 |
| 2011/0073586 | A1 * | 3/2011 | Lim | F25D 21/08 219/546 |
| 2011/0132588 | A1 | 6/2011 | Petrenko et al. | |

FOREIGN PATENT DOCUMENTS

| | | | |
|---|---|---|---|
| DE | 1476989 | | 10/1969 |
| DE | 2510660 | A1 | 9/1976 |
| DE | 2510755 | A1 | 9/1976 |
| DE | 3626613 | A1 | 2/1988 |
| DE | 3921900 | C1 | 7/1996 |
| DE | 4440634 | A1 | 7/1996 |
| EP | 1168888 | A2 | 1/2002 |
| FR | 2570333 | A1 | 3/1986 |
| GB | 820908 | | 9/1959 |
| GB | 917055 | | 1/1963 |
| GB | 2106966 | A | 4/1983 |
| GB | 2252285 | A | 8/1992 |
| GB | 2259287 | A | 3/1993 |
| GB | 2261333 | A | 5/1993 |
| GB | 2319943 | A | 6/1998 |
| JP | 5-292638 | A | 11/1993 |
| JP | 7-23520 | A | 1/1995 |
| JP | 2005-180823 | A | 7/2005 |
| JP | 2005-180824 | | 7/2005 |
| JP | 2008-011697 | | 1/2008 |
| RU | 2004127250 | A | 1/2006 |
| SU | 983433 | | 12/1982 |
| WO | WO-2000/024634 | A1 | 5/2000 |
| WO | WO-2000/033614 | A2 | 6/2000 |
| WO | WO-2000/052966 | A1 | 9/2000 |
| WO | WO-2001/008973 | A1 | 2/2001 |
| WO | WO-2001/0049564 | A1 | 7/2001 |
| WO | WO-2003/062056 | A1 | 7/2003 |
| WO | WO-2003/069955 | A1 | 8/2003 |
| WO | WO-2005/061974 | A1 | 7/2005 |
| WO | WO-2006/002224 | A2 | 1/2006 |
| WO | WO-2006/081180 | A2 | 8/2006 |
| WO | WO-2007/021270 | A2 | 2/2007 |

OTHER PUBLICATIONS

International Preliminary Report on Patentability received for PCT Patent Application No. PCT/US2009/063407 dated May 19, 2011, 7 pages.

"Icing Wind Tunnel", Meeting the Challenges of Ice Testing in a World-Class Facility, The BFGoodrich Aerospace, 1994, 4 pages.

"EverStart Automotive", available on line at <http://www.everstart-batteries.com/products/use/automotive.asp>, retrieved on May 5, 2003, 1 page.

"Maxwell Technologies: Ultracapacitors—Boostcap PC2500", available online at <http://www.maxwell.com/ultracapacitors/products/PC2500.html>, retrieved on May 5, 2003, pp. 1-2.

Courville et al., "De-Icing Layers of Interdigitated Microelectrodes", Mat. Res. Soc. Symp. Proc., vol. 604, 2000, pp. 329-334.

Incropera et al., "Fundamentals of Heat and Mass Transfer", Fifth Edition, 2002, pp. 596-601.

Petrenko et al., "Pulse Electrothermal De-Icing", Proceedings of the Thirteenth International Offshore and Polar Engineering Conference, May 2003, pp. 435-438.

Petrenko et al., "Action of Electric Fields on the Plastic Deformation of Pure and Doped Ice Single Crystals", Philosophical Magazine A., vol. 67, No. 1, 1993, pp. 173-185.

Petrenko et al., "Physics of Ice", Oxford University Press, 1998, 195 pages.

Petrenko et al., "Reduction of Ice Adhesion to Metal by Using Self-Assembling Monolayers (SAM's)", Canadian Journal of Physics, vol. 81, 2003, pp. 387-393.

Petrenko et al., "Reduction of Ice Adhesion to Stainless Steel by Ice Electrolysis", Journal of Applied Physics, vol. 86, No. 10, Nov. 15, 1999, pp. 5450-5454.

Petrenko et al., "The Effect of Static Electric Fields on Protonic Codductivity of Ice Single Crystals", Philosophical Magazine B, vol. 66, No. 3, 1992, pp. 341-353.

Petrenko, Victor F., "Electromechanical Phenomena in Ice", Cold Regions Research & Engineering Laboratory, Feb. 1996, 41 pages.

Petrenko et al., "Generation of Electric Fields by Ice and Snow Friction", J. Appl. Phys., vol. 77, No. 9, May 1, 1995, pp. 4518-4521.

Petrenko, Victor F., "Surface of Ice, Ice/Solid and Ice/Liquid Interfaces with Scanning Force Microscopy", J. Phys. Chem. B., Oct. 1996, 6 pages.

Petrenko, Victor F., "The Effect of Static Electric Fields on Ice Friction", J. Appl. Phys. vol. 76, No. 2, Jul. 15, 1994, pp. 1216-1219.

Phillips Edward H., "New Goodrich Wind Tunnel Tests Advanced Aircraft De-Icinq Systems", Aeronautical Engineering, 1988, 3 pages.

Reich, A., "Interface Influences Upon Ice Adhesion to Airfoil Materials", 32nd Aerospace sciences meeting & Exhibit, Jan. 1994, 9 pages.

* cited by examiner

FIG. 1A (Exemplary Embodiment)
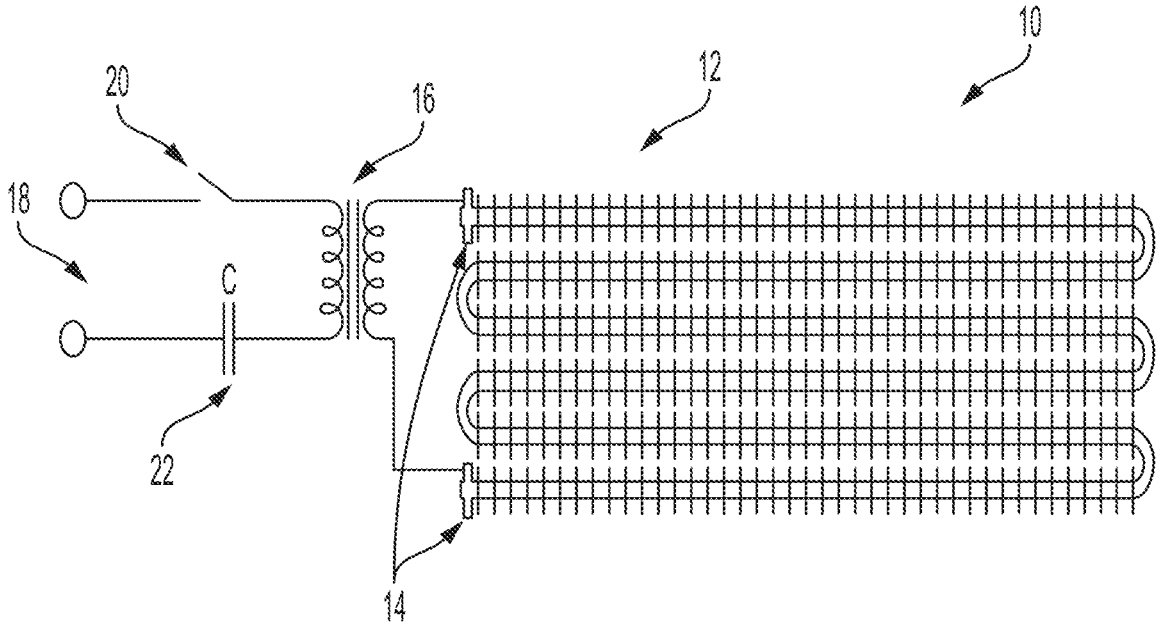

FIG. 1B (Exemplary Embodiment)
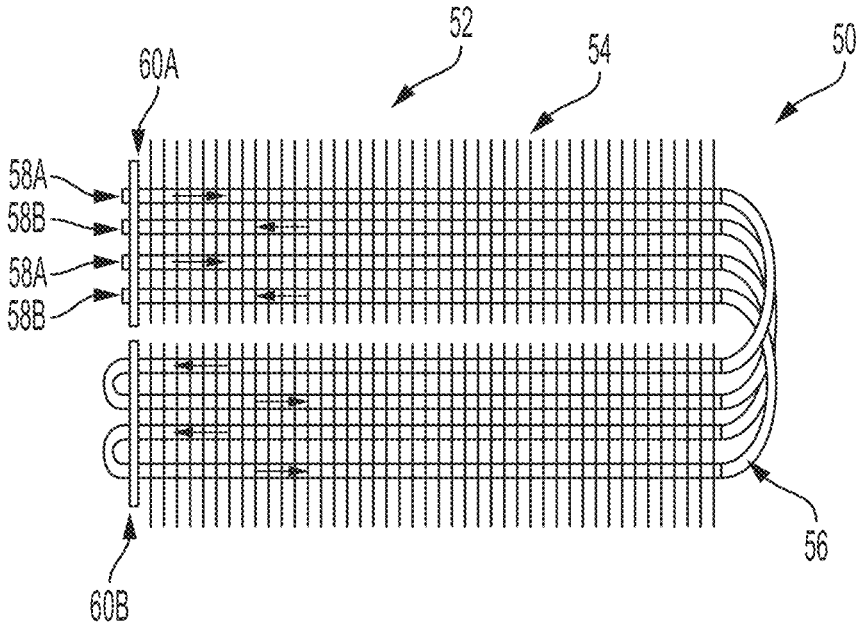

FIG. 1C (Exemplary Embodiment)
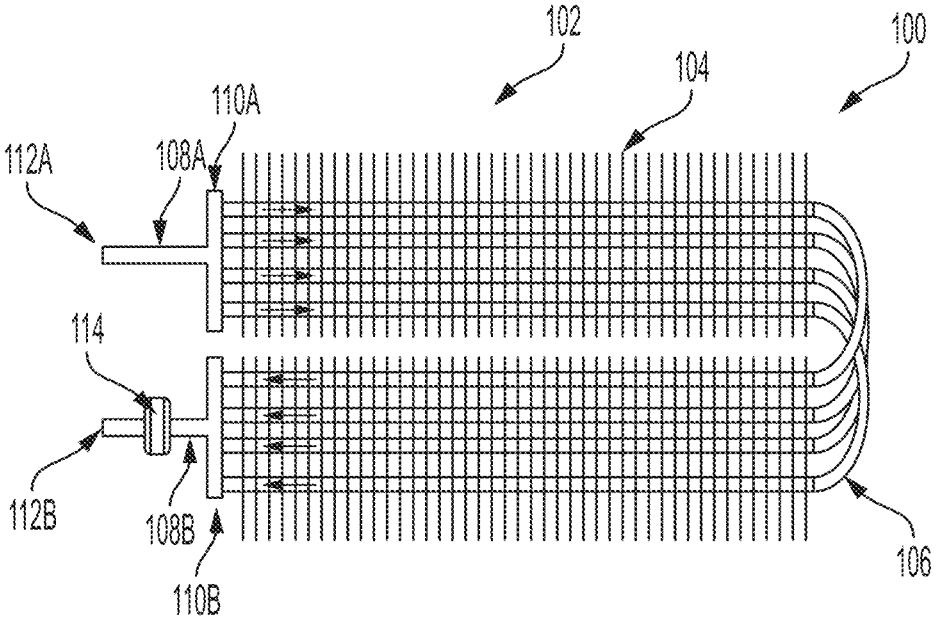

FIG. 2A (Exemplary Embodiment)
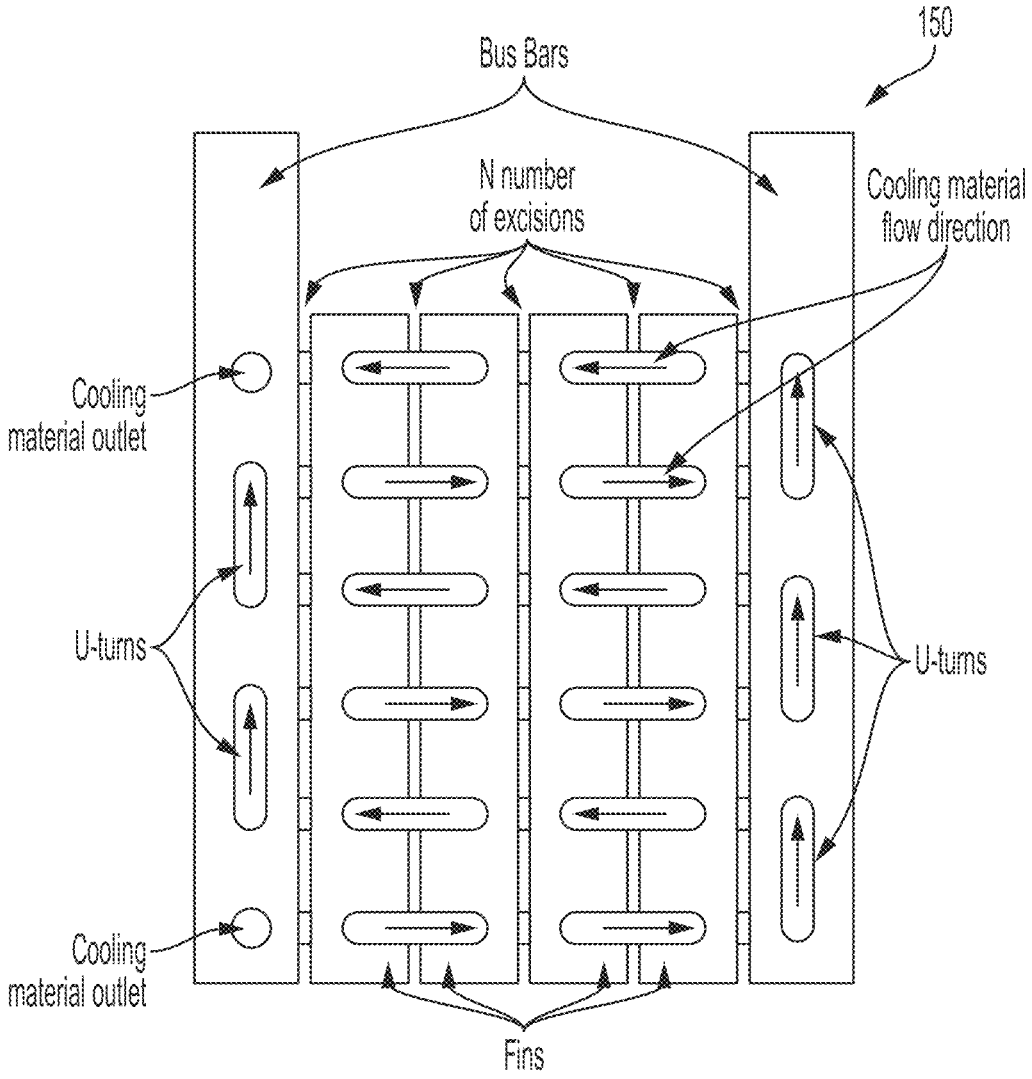

FIG. 2B (Exemplary Embodiment)
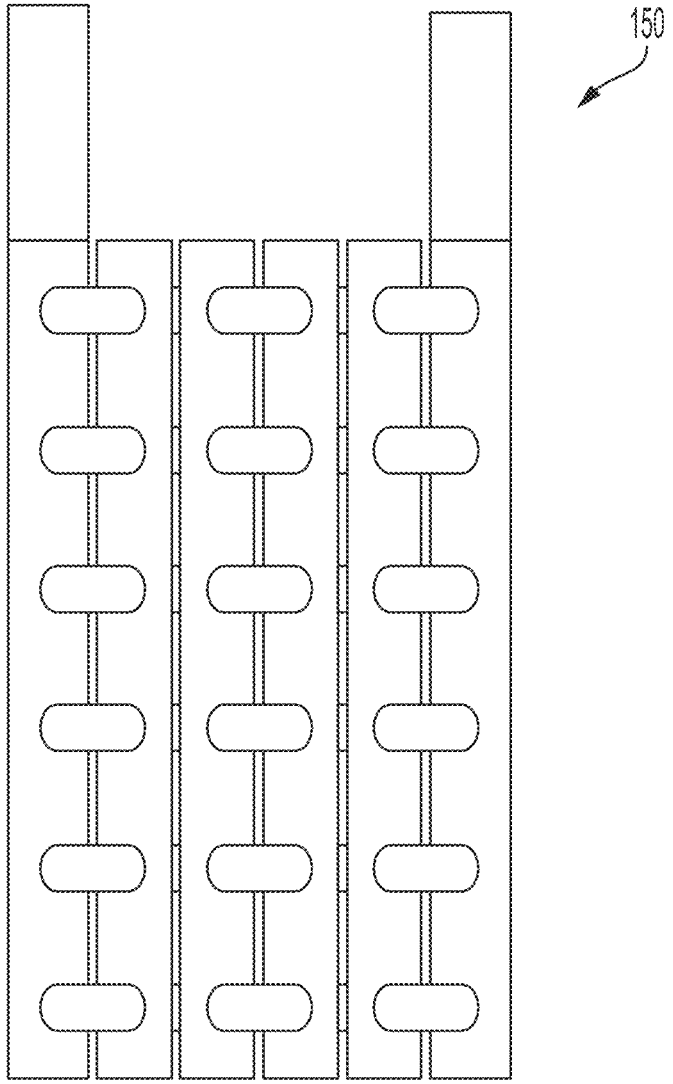

FIG. 3 (Exemplary Embodiment)
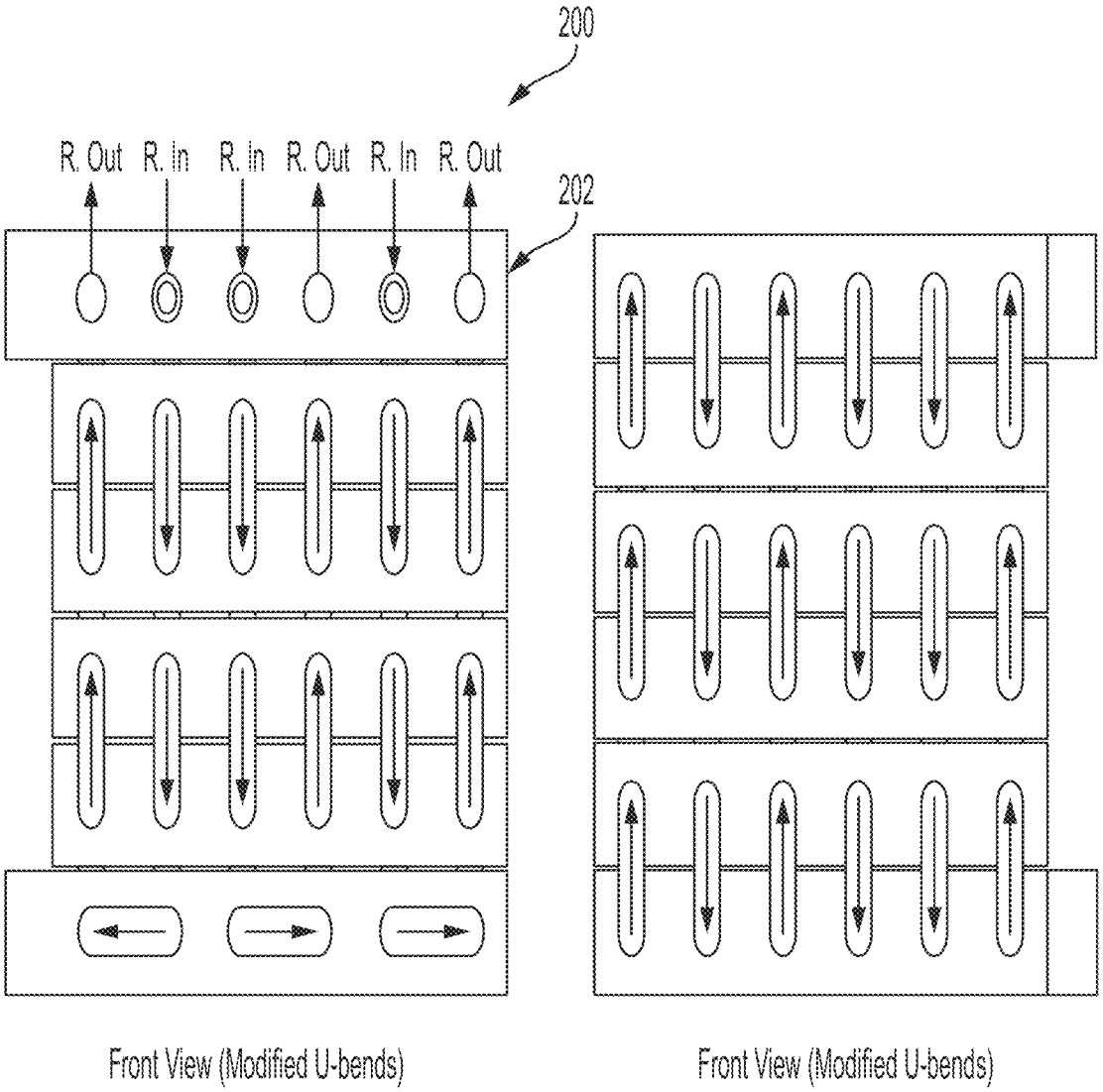

FIG. 4A (Exemplary Embodiment)
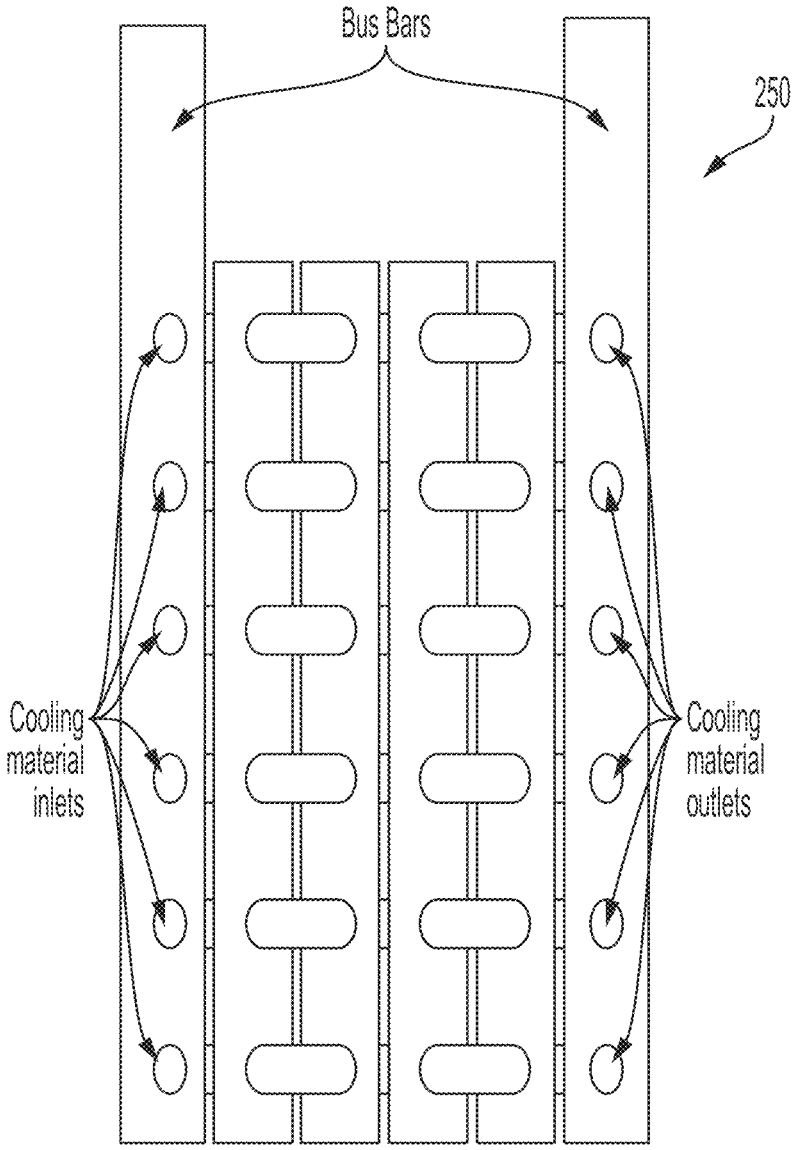

FIG. 4B (Exemplary Embodiment)
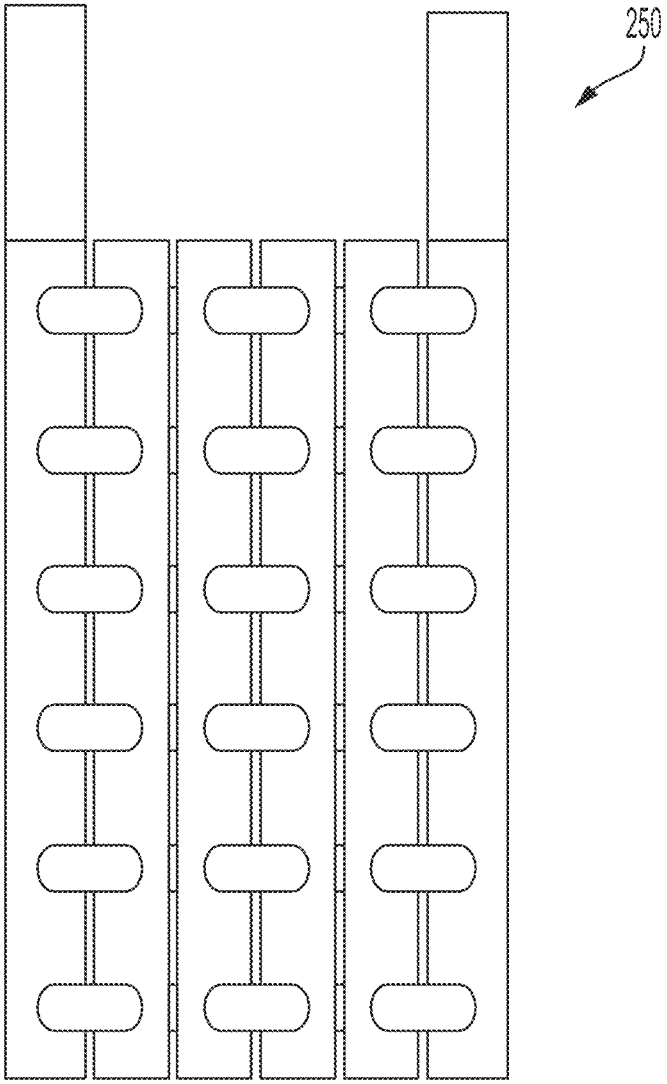

FIG. 4C (Exemplary Embodiment)
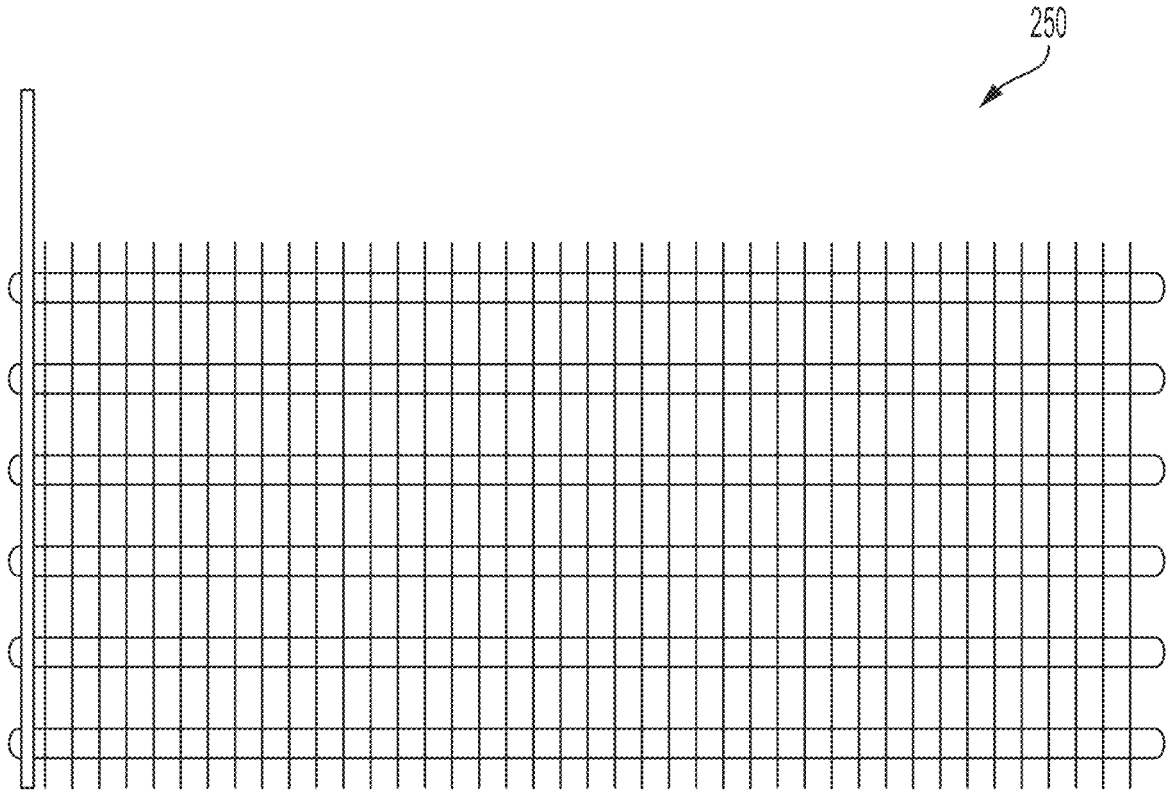

FIG. 4D (Exemplary Embodiment)
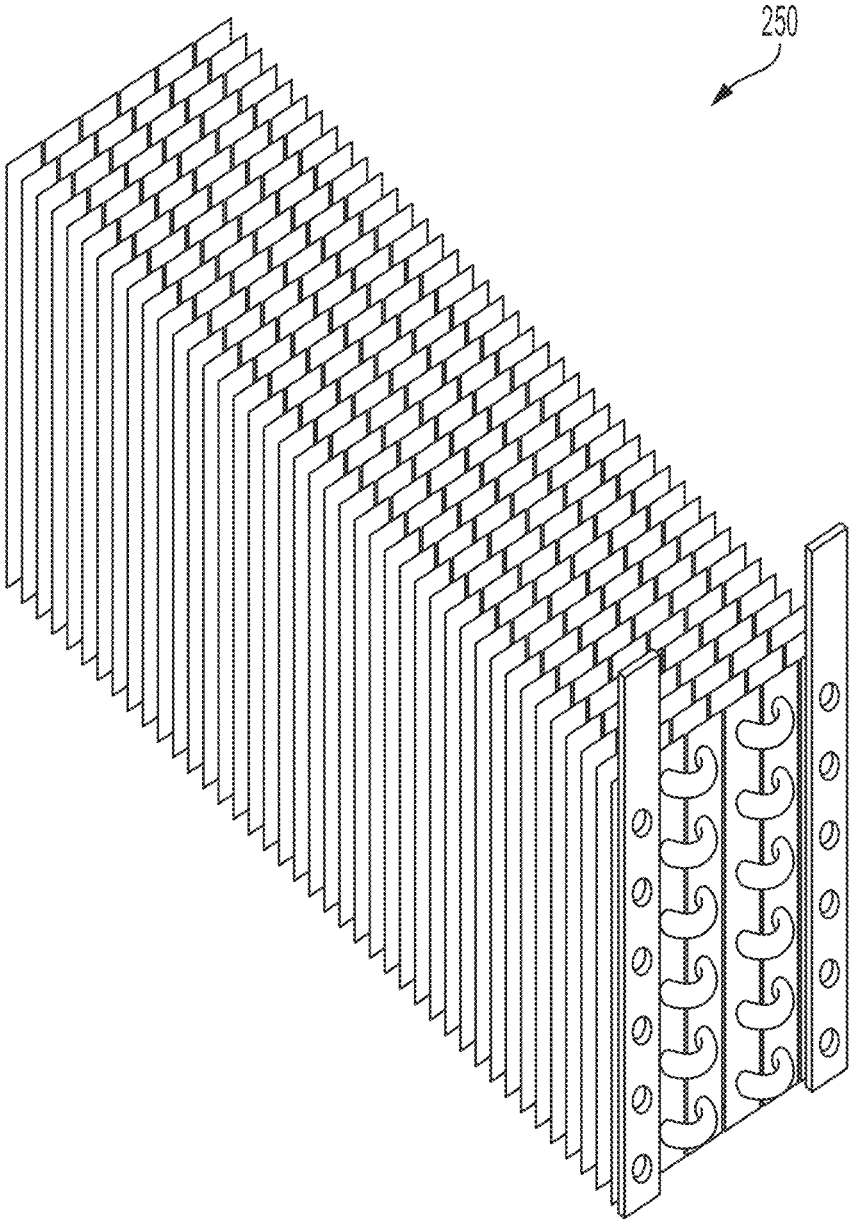

FIG. 4E (Exemplary Embodiment)
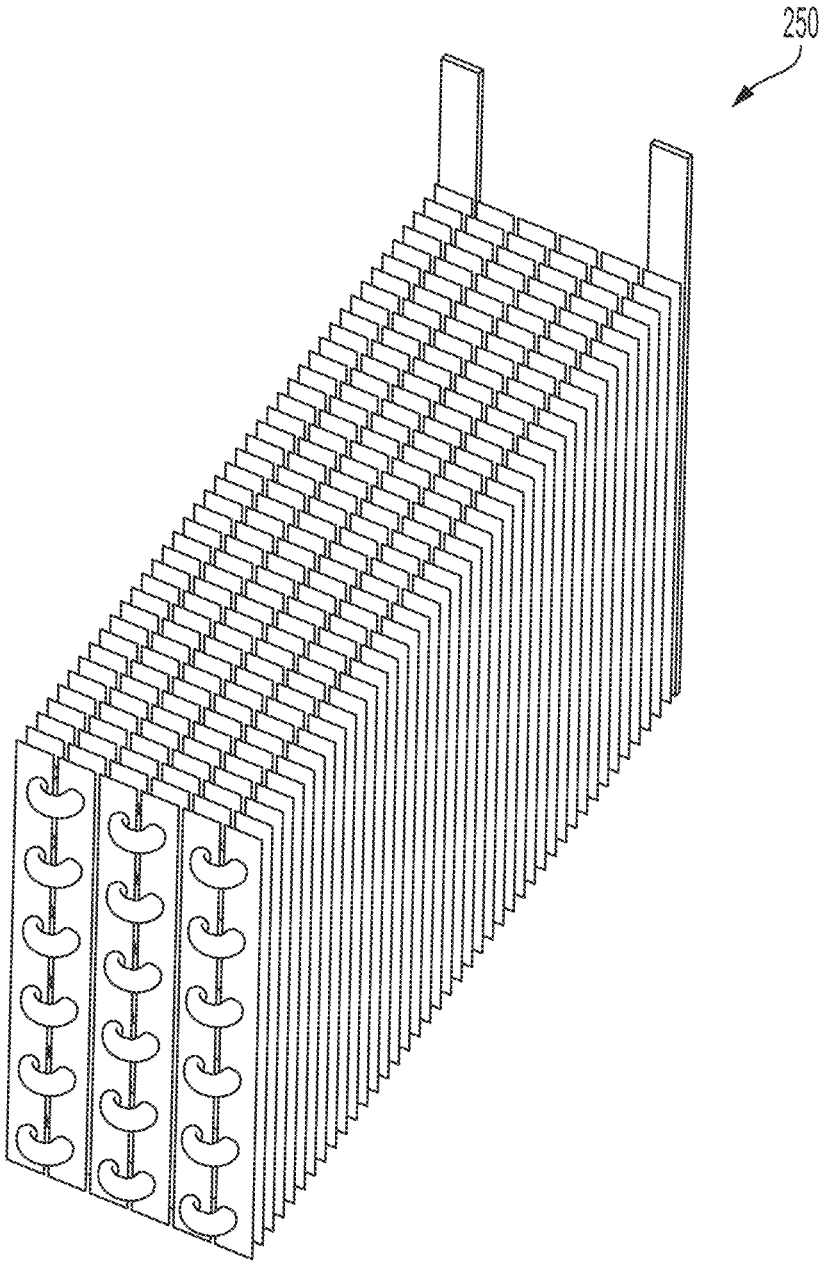

SYSTEM AND METHOD FOR ENERGY-SAVING INDUCTIVE HEATING OF EVAPORATORS AND OTHER HEAT-EXCHANGERS

CROSS REFERENCE TO RELATED APPLICATIONS

The present patent application is a continuation application of U.S. patent application Ser. No. 12/953,271, filed on Nov. 23, 2010, which is hereby incorporated by reference in its entirety and which claims priority from the commonly assigned U.S. provisional patent application 61/263,550, filed Nov. 23, 2009.

FIELD OF THE INVENTION

The present invention relates generally to fins-on-tubes type evaporator and heat exchanger systems, and more particularly to fins-on-tubes type evaporator and heat exchanger systems optimized for energy-saving inductive heating thereof.

BACKGROUND

Evaporators and other heat-exchanger systems are in widespread use in an enormous variety of cooling, refrigeration, HVAC, and other applications in virtually every market and market sector ranging from residential, vehicular, commercial, to medical, scientific and industrial.

The most common type of conventional evaporators/heat exchangers is a fins-on-tube configuration (such as shown by way of example in FIG. 5). During normal operation, such evaporators accumulate frost on the surfaces of the fins and tubes over time which increasing restricts the airflow through the evaporator and decreases its performance.

As a result, evaporators must be subjected to regular defrost cycles (usually several times per day) to remove the undesired frost from the fins. A variety of defrosting techniques are well known in the art, most of which typically involve heating the evaporators over an extended period of time, either directly, or indirectly (e.g., by directing heated air or other heated gas over them). However, such defrost cycles are time consuming and thus also consume a great deal of energy and also produce undesirable heat within the space being refrigerated, such as a freezer compartment.

Accordingly, virtually all conventional evaporators have a low fin density to allow sufficient spacing between each fin so that frost would not completely block airflow through the evaporator before the next defrost cycle. However, a lower fin density also lowers the performance and efficiency of the evaporator.

In recent years, a new technology known as Pulse Electro-Thermal Deicing/Defrosting (PETD), has been successfully introduced and implemented in various defrosting applications. Specifically, PETD utilizes rapid resistive heating of particular element for fast and efficient defrosting thereof. However, in order for PETD to work properly, the working element to be defrosted must have a suitable minimum resistance value. But notwithstanding this requirement, the use of PETD in defrosting applications is particularly advantageous, because the lower overall energy usage/and much shorter duration of a PETD defrost cycle allows more frequent but efficient and energy-saving defrosting cycles, which enables PETD-equipped evaporators to be constructed with a greater fin density, and thus to be configured with a significantly lower volume than a corresponding conventional evaporator with similar cooling performance characteristics.

Unfortunately, while PETD can be readily utilized with specially constructed PETD-enabled evaporators, it is virtually impossible to use PETD with conventional fins-on-tubes evaporators/heat exchanges. This is because conventional fins-on-tubes evaporators/heat exchangers have an extremely low electrical resistance (e.g., 10 μΩ to 100 μΩ). Such a low resistance value means that in order to utilize PETD therewith to heat the evaporator, extremely high electric currents would need to be applied thereto (e.g., 10,000 A would need to be applied to a 10 μΩ resistance evaporator to generate a necessary value of 1 kW of heating power). Naturally, it is difficult and quite expensive to provide a power supply for the evaporator that is capable of delivering such a high current.

Even worse, the value of an inductive reactance of conventional evaporators exceed their electrical resistance by more than one order of magnitude. As a result, the voltage value required to induce the above-mentioned high current, is over 10 times than the value of voltage that would be necessary in the absence of that undesirable inductance.

Thus, it would be desirable to provide an evaporator/heat exchanger system based on a conventional fins-and-tubes design, but that is configured for advantageous utilization of inductive energy-saving rapid heating/defrost techniques. It would also be desirable to provide an evaporator/heat exchanger system based on a conventional fins-and-tubes design, that is optimized for use of inductive energy-saving rapid heating/defrost techniques therewith, but that is inexpensive, easy to manufacture, and that is capable of 1:1 replacement of correspondingly sized conventional evaporator/heat exchanger components. It would further be desirable to provide a method for modifying/reconfiguring a conventional fins-and-tubes evaporator/heat exchanger system, to optimize that system for utilization of inductive energy-saving rapid heating/defrost techniques (such as PETD) therewith.

SUMMARY OF THE INVENTION

The various exemplary embodiments of the present invention provide a novel fins-on-tubes type evaporator/heat exchanger system that is optimized for energy-saving inductive heating thereof, for example by way of application of Pulse Electro-Thermal Deicing/Defrosting (PETD) or equivalent technique thereto, by configuring it to increasing its resistance to a value at which the system's reactance at its working frequency is comparable to its electrical resistance.

Advantageously, the inventive system may be advantageously configured to comprise the same form factor and interface as a conventional fins-on-tubes type evaporator/heat exchanger component, such that the inventive evaporator/heat exchanger system may be readily utilized for replacement thereof. The inventive evaporator/heat exchanger system includes a set of tubes configured for flow of cooling material (such as refrigerant fluid or gas) therethrough, and also includes a set of fins positioned and disposed perpendicular to, and along, the tubes, in such a way that at least a portion of the fins comprise N number of longitudinal excisions therein, each of a predetermined length, and each oriented in a direction parallel to the tubes.

In a preferred embodiment of the present invention, the excisions are positioned and configured to partition the inventive evaporator/heat exchanger system into an N+1 number of sequential evaporator sections, such that the tubes form an electrical series connection between the sequential evaporator sections, and such that the excisions cause an increase in the electrical resistance of the evaporator system by about a factor of $(N+1)^2$, thereby facilitating utilization of energy-saving inductive heating means (such as PETD) therewith.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote corresponding or similar elements throughout the various figures:

FIG. 1A shows a diagram of an exemplary first embodiment of an inventive evaporator/heat exchanger configured for advantageous utilization of inductive energy-saving rapid heating/defrost techniques, and supplied with a PETD defrost system by way of example;

FIG. 1B shows a diagram of an exemplary second embodiment of an inventive evaporator/heat exchanger configured, by way of example, as a PETD enabled evaporator having two electrically conductive sections connected in series, and two cooling material flow circuits connected in parallel;

FIG. 1C shows a diagram of an alternate exemplary embodiment of an inventive evaporator/heat exchanger configured, by way of example, as a PETD enabled evaporator having two electrically conductive sections connected in series, and four cooling material flow circuits connected in parallel;

FIG. 2A shows a front longitudinal view of an exemplary embodiment of the inventive evaporator/heat exchanger which has been configured to comprise one series electric circuit formed by separate sequential evaporator sections resulting from at least one excision made in at least one predetermined fin, and a separate at least one parallel cooling material flow circuit, formed by the tubes and the U-turns;

FIG. 2B shows a back longitudinal view of the inventive evaporator/heat exchanger embodiment of FIG. 2A;

FIG. 3 shows an exemplary tubing orientation and exemplary cooling material flow through multiple parallel cooling material flow circuits of the inventive evaporator/heat exchanger;

FIG. 4A shows a front isometric view of the inventive evaporator/heat exchanger embodiment with a plurality of parallel cooling material flow circuits;

FIG. 4B shows a rear isometric view of the inventive evaporator/heat exchanger embodiment of FIG. 4A;

FIG. 4C shows a side cross-sectional view of the inventive evaporator/heat exchanger embodiment of FIG. 4A;

FIG. 4D shows a front longitudinal view of the inventive evaporator/heat exchanger embodiment of FIG. 4A;

FIG. 4E shows a rear longitudinal view of the inventive evaporator/heat exchanger embodiment of FIG. 4A.

DETAILED DESCRIPTION

Figure 5:
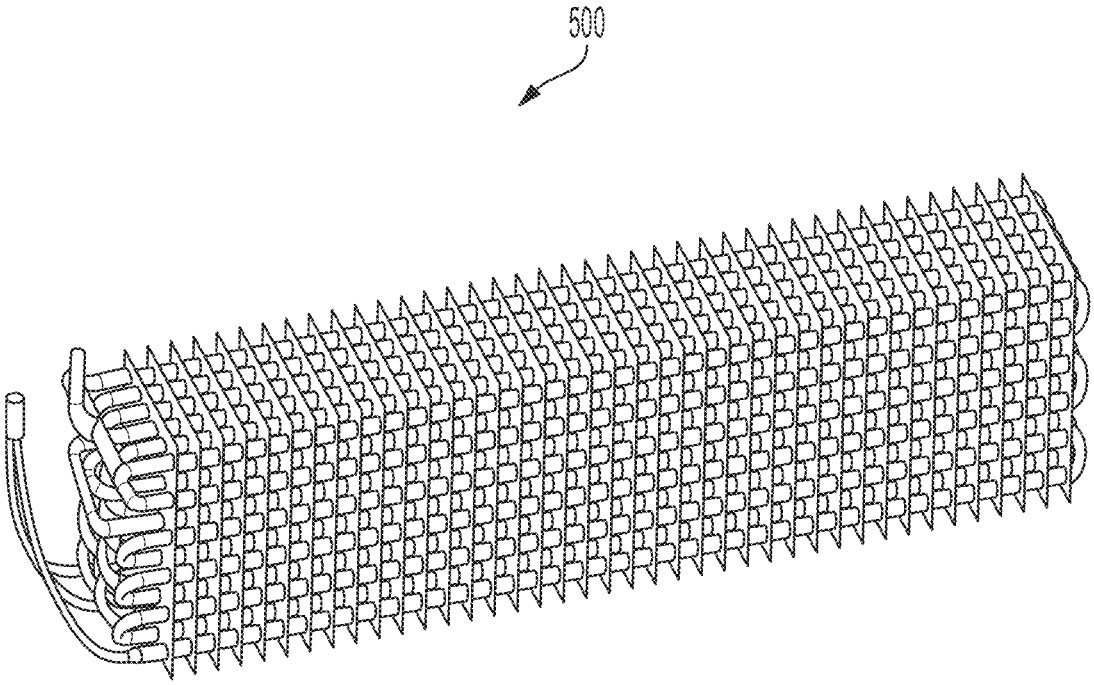
FIG. 5 (Prior Art)
FIG. 5 shows an isometric view of a prior art conventional fin-on-tubes evaporator/heat exchanger.

The present invention provides various advantageous embodiments of a novel fins-on-tubes type evaporator/heat exchanger system that is optimized for energy-saving rapid inductive heating thereof, for example by way of application of Pulse Electro-Thermal Deicing/Defrosting (PETD), or equivalent technique thereto, by configuring an evaporator/heat exchanger to comprise a target resistance value suitable for efficient heating by inductive currents. In accordance with the present invention, for systems employing alternating current electrical power supplies, this target electrical resistance value is preferably of a magnitude that is at least as high as a magnitude of an inductive reactance value of the inventive evaporator/heat-exchanger system.

The present invention provides a novel, but simple and efficient technique for significantly increasing an evaporators' resistance while keeping its inductance and a refrigerant pressure drop at approximately the same stable value, or even reducing it. The application of the inventive techniques described herein, to modify conventional evaporators, reduces the current required for high-power heating (such as PETD) by at least several orders of magnitude, and furthermore greatly increases the efficiency of such heating.

Advantageously, the inventive system may be configured to comprise the same form factor and interface as various conventional fins-on-tubes type evaporator/heat exchanger components, such that the inventive evaporator/heat exchanger system may be readily utilized for replacement thereof.

Referring now to FIG. 1A to FIG. 4E, the inventive evaporator/heat exchanger system includes a set of tubes configured for enabling flow of cooling material (such as refrigerant fluid or gas) therethrough, and also includes a set of fins positioned and disposed perpendicular to, and along, the tubes, in such a way that at least a portion of the fins comprise N number of longitudinal excisions therein, where N=1, 2, 3 . . . etc., each of a predetermined length, and each oriented in a direction parallel to the tubes.

In a preferred embodiment of the present invention, the excisions are positioned and configured to partition the inventive evaporator/heat exchanger system into an N+1 number of sequential electrically conductive evaporator sections, such that the tubes form an electrically conductive series connection between the sequential evaporator sections, and such that the excisions cause an increase in the electrical resistance of the evaporator system by a factor of about $(N+1)^2$, thereby facilitating utilization of energy-saving inductive heating means (such as PETD) therewith.

It should be noted, that the above-mentioned utilization of excisions or cuts configured and positioned to modify the evaporator fins to thereby split the inventive system into plural sequential electrically conductive evaporator sections, is not intended as a limitation to any other type of modifications to the evaporator components that may be made, as a matter of design choice and without departing from the spirit of the present invention, to achieve the same purpose of forming a series "electrical circuit" comprising sequential partitioned sections of the evaporator/heat exchanger system, that greatly increases the system's electrical resistance.

Referring now to FIG. 1A, in which an exemplary inventive evaporator/heat exchanger system 10 is shown, the evaporator/heat exchanger system 10 includes the cooling material flow tubes/conductive fins component 12, with each of the tubes' flow inlets and outlets being connected to electrically conductive elements 14 (e.g., bus bars, etc.). The system 10 may also include a primary power supply 18, such as a conventional 115 VAC/60 Hz or 230 VAC/50 Hz electrical power line, connected to the electrically conductive elements 14, and may optionally also include a line current increasing component 16, operable to increase the line current to a magnitude sufficient to heat the evaporator to a desirable temperature over limited time interval. The line current increasing component 16 may be a conventional step-down transformer, or an intermittent-action step down transformer (which is smaller and cheaper than a conventional transformer), or an electronic transformer that includes either an AC-AC inverter or an AC-DC inverter.

In at least one embodiment of the system 10 of the present invention, the power supply 18 may also include an electrical switch 20, and may further include an optional resonant capacitor 22 that is operable to compensate for an inductive reactance of the evaporator/heat exchanger system 10.

Referring now to FIG. 1B, a second embodiment of the inventive evaporator/heat exchanger system is shown as an exemplary evaporator/heat exchanger system 50, having a multi-part main component 52 comprising cooling material flow tubes 56 and conductive fins 54, configured with multiple electrically conductive system sections connected in a series electrically conductive configuration, as well as multiple cooling material flow circuits configured in a parallel configuration (two electrically conductive sections and two cooling material flow circuits are shown by way of example only). The evaporator/heat exchanger system 50 is readily configured to function with various electrical power systems and optionally with current increasing components (and optional subcomponents), such as components 16 to 22 of FIG. 1A, above, in a similar manner as the system 10, except in a different connection configuration, as provided below.

The evaporator/heat exchanger system 50 includes the cooling tubes 56 flow inlets 58A and flow outlets 58B being connected to a first electrically conductive element 60A (e.g., bus bar, etc.) that is preferably connected to the ground and one electrical potential of a line current increasing component (such as component 16 of FIG. 1A) (e.g., to a low potential end of a transformer's secondary winding), and also includes a second electrically conductive element 60B (e.g., bus bar, etc.), positioned substantially at a midpoint of the multi-part main component 52, that is preferably connected to the ground and to another electrical potential of the line current increasing component (such as component 16 of FIG. 1A) (e.g., to a high potential end of a transformer's secondary winding).

In accordance with the present invention, when multiple separate parallel cooling material flow circuits are being utilized, for optimal system performance, it is preferable to ensure that all of the system cooling material flow circuits are maintained in substantially similar thermal conditions.

It should be noted, that while the use of dielectric unions in evaporator/heat exchanger systems brings a number of drawbacks and challenges in terms of increased manufacturing complexity, greater expense, and reduced long-term reliability, in certain cases, the inventive system may employ dielectric unions on a limited basis to provide an advantageous embodiment of the present invention in which the cooling material pressure drop between multiple cooling material flow circuits could be very significantly reduced.

Referring now to FIG. 1C, an alternate embodiment of the inventive evaporator/heat exchanger system is shown as an exemplary evaporator/heat exchanger system 100, having a multi-part main component 102 comprising cooling material flow tubes 106 and conductive fins 104, configured with multiple electrically conductive system sections connected in a series electrically conductive configuration, as well as multiple cooling material flow circuits configured in a parallel configuration. The evaporator/heat exchanger system 100 is readily configured to function with various electrical power systems and optionally with current increasing components (and optional subcomponents), such as components 16 to 22 of FIG. 1A, above, in a similar manner as the system 10, except in a different connection configurations and additional elements 110A, 110B and 114, as provided below.

The evaporator/heat exchanger system 100 includes a cooling material flow inlet 108A connected to cooling material flow tubes 106 flow inlets by way of a first conductive flow distribution manifold 110A (functioning as a first electrically conductive element) that is preferably connected to the ground and one electrical potential of a line current increasing component (such as component 16 of FIG. 1A) (e.g., to a low potential end of a transformer's secondary winding), and also includes a cooling material flow outlet 108B connected to cooling material flow tubes 106 flow outlets by way of a second conductive flow distribution manifold 110B (functioning as a second electrically conductive element) that is preferably connected to another electrical potential of a line current increasing component (such as component 16 of FIG. 1A) (e.g., to a high potential end of a transformer's secondary winding). However, unlike the systems 10, and 50 of FIGS. 1A and 1B, respectively, preferably the system 100 includes at least one dielectric union 114 positioned between the electrical connection of the second conductive manifold 110B and the rest of the system 100.

The various above-mentioned exemplary embodiments of the novel evaporator/heat exchanger system (in which N=5), would have $(N+1)^2=6^2=36$ times higher electrical resistance, R, than that of a conventional evaporator, such as the one shown in FIG. 5. Because the heating power generated by an electric current I, is equal to $P=R\cdot I^2$, the current required to heat the inventive exemplary evaporators, is six times less than that required for a conventional previously known evaporator shown, by way of example, as an evaporator 500 in FIG. 5.

As is known in the art of refrigeration, the number of parallel liquid circuits available for flow of refrigerant has a very significant effect on the magnitude of a cooling material (hereinafter referred to as "refrigerant") pressure drop across the evaporator, and on the overall evaporator heat-exchange rate. For that reason, is very desirable to be able to vary the number of the liquid refrigerant flow circuits without reducing a high electrical resistance of the evaporator achievable by this invention.

As it seen from FIG. 2A to FIG. 4E it is possible to select, as a matter of design choice, and without departing from the spirit of the invention, the desired number of parallel circuits for flow of the refrigerant, without requiring any changes to the electrical series connections of the evaporator/heat exchanger sections. For instance, by way of example only, FIGS. 1A, and 2A, 2B show exemplary embodiments of the inventive evaporators/heat exchangers 10, 150 having one, two and four flow circuits for the refrigerant respectively, while FIG. 3 shows an alternate embodiment of the inventive evaporator 200 having three parallel cooling material flow circuits with all three inlets and all three outlets connected to the same electrically conductive bus bar 202. This arrangement is particularly advantageous because it eliminates the need for using any dielectric unions which raise system expense (and manufacturing complexity), as well as reduce long term reliability.

Yet another alternate embodiment of the inventive evaporator having six parallel refrigerant flow circuits is shown, in various views, in FIGS. 4A to 4E as an evaporator/heat exchanger 250.

Additional advantageous results can be achieved by using at least one dielectric union (or any equivalent component or element suitable for the same or similar purpose) to cross-link the evaporator tubes. Such cross-links do not effect the electrical parameters (such as resistance) of the evaporator, but allow to design the evaporator with a desirable amount of parallel liquid circuits. Referring now to FIG. 2A to FIG. 4E, exemplary configurations of multiple parallel cooling material flow circuits are shown by way of illustrative examples.

Advantageously, the inventive evaporator/heat exchanger system enable utilization of very efficient rapid defrosting techniques, such as PETD, to efficiently and quickly defrost evaporators/heat exchangers with only minimal changes to the existing manufacturing processes.

Thus, while there have been shown and described and pointed out fundamental novel features of the inventive apparatus as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A method for deicing a fins-on-tubes evaporator system with a predetermined electrical resistance, the method comprising:

inducing an electric current in the fins-on-tubes evaporator system, wherein the system comprises:

a plurality of cooling material flow tubes electrically connected in parallel to one another; wherein each of the cooling material flow tubes comprises at least a first electrically conductive section electrically connected in series to a second electrically conductive section, and wherein inducing the electric current causes the electric current to flow through the first electrically conductive section and the second electrically conductive section; and a plurality of fins attached to the cooling material flow tubes.

2. The method of claim 1, wherein the plurality of fins are perpendicularly attached to the cooling material flow tubes.

3. The method of claim 1, wherein the plurality of fins links the plurality of cooling material flow tubes.

4. The method of claim 3, wherein the plurality of fins are electrically conductive elements.

5. The method of claim 1, wherein the cooling material flow tubes are linked through two or more bus bars that electrically connect the cooling material flow tubes in parallel to one another.

6. The method of claim 1, wherein the cooling material flow tubes are linked through an electrically conductive manifold electrically connecting the cooling material flow tubes to one another.

7. The method of claim 1, wherein the first electrically conductive section and the second electrically conductive section of each cooling material flow tube are interconnected by a U-turn.

8. The method of claim 1, wherein the electric current is an alternating current.

9. The method of claim 1, wherein the electric current is induced using a 115 VAC/60 Hz power supply or a 230 VAC/50 Hz power supply.

10. The method of claim 1, wherein the system comprises two or more separate cooling material flow tubes electrically connected in parallel to one another.

11. The method of claim 1, wherein the induced electrical current removes frost accumulated on the system.

12. The method of claim 10, comprising flowing refrigerant fluid through the two or more separate cooling material flow tubes.

* * * * *